US011745114B1

(12) United States Patent
Van Hise

(10) Patent No.: US 11,745,114 B1
(45) Date of Patent: Sep. 5, 2023

(54) ADJUSTABLE WEIGHTED BALLOON HANDLE

(71) Applicant: Mark S. Van Hise, Las Vegas, NV (US)

(72) Inventor: Mark S. Van Hise, Las Vegas, NV (US)

( * ) Notice: Subject to any disclaimer, the term of this patent is extended or adjusted under 35 U.S.C. 154(b) by 0 days.

(21) Appl. No.: 17/465,003

(22) Filed: Sep. 2, 2021

Related U.S. Application Data

(60) Provisional application No. 63/151,577, filed on Feb. 19, 2021.

(51) Int. Cl.
*A63H 27/10* (2006.01)

(52) U.S. Cl.
CPC ..... *A63H 27/10* (2013.01); *A63H 2027/1008* (2013.01); *A63H 2027/1041* (2013.01)

(58) Field of Classification Search
CPC ..... A63H 27/10; A63H 2027/1008; A63H 2027/1041; A63H 2027/105
USPC ..... 446/222, 224
See application file for complete search history.

(56) References Cited

U.S. PATENT DOCUMENTS 4,307,537 A 12/1981 Bergmann
4,547,167 A 10/1985 Bergmann
5,199,667 A 4/1993 Fujii
5,403,222 A * 4/1995 Koenig ..... A63F 9/0079 446/175
5,573,437 A * 11/1996 Van Dyke ..... B42D 15/045 446/79
5,765,831 A * 6/1998 Huffhines ..... A63H 27/10 273/DIG. 30
5,874,144 A * 2/1999 Kumar ..... C08F 220/12 428/355 R
5,893,790 A * 4/1999 Montgomery ..... A63H 27/10 446/225
6,435,935 B1 * 8/2002 Komaba ..... A63H 27/10 446/220
6,582,272 B1 * 6/2003 Nelson ..... A63H 27/10 446/220
6,663,460 B1 * 12/2003 Nelson ..... A63H 27/10 446/220
6,666,405 B2 * 12/2003 Isaacs ..... B64B 1/70 244/33
8,091,826 B2 1/2012 Voorhees
8,152,588 B2 4/2012 Hua
(Continued)

FOREIGN PATENT DOCUMENTS

ES 2719903 7/2019
WO 1982002840 9/1982
WO 2002045809 6/2002

*Primary Examiner* — Joseph B Baldori
(74) *Attorney, Agent, or Firm* — Invention To Patent Services; Alex Hobson

(57) ABSTRACT

The present invention is directed to an adjustable weighted balloon handle that allows for a balloon to levitate an intermediate distance off the ground. The adjustable weighted balloon handle includes a plurality of strips having a plurality of perforations creating tabs, wherein the tabs may be removed to adjust the weight of the handle. The adjustable weighted balloon handle may solve a number of problems currently associated with helium and other lighter-than-air balloons. Namely, the adjustable weighted balloon handle may allow a user to levitate a balloon off the ground and not force the user to tether the balloon to a surface.

13 Claims, 7 Drawing Sheets

(56) References Cited

U.S. PATENT DOCUMENTS

| | | | | |
|---|---|---|---|---|
| 9,480,930 | B2 | 11/2016 | Bergmann | |
| 2003/0057580 | A1* | 3/2003 | Rosenberg | A63H 27/10<br>264/10 |
| 2005/0009439 | A1 | 1/2005 | Ahn | |
| 2006/0292959 | A1 | 12/2006 | Greenwald et al. | |
| 2009/0275260 | A1* | 11/2009 | Lockett | A63H 27/10<br>446/222 |
| 2013/0157540 | A1* | 6/2013 | Bergmann | A63H 27/10<br>446/220 |

* cited by examiner

ADJUSTABLE WEIGHTED BALLOON HANDLE

CROSS-REFERENCE TO RELATED APPLICATIONS

This application claims the benefit of U.S. Provisional Patent Application No. 63/151,577, filed on Feb. 19, 2021, which is incorporated by reference herein in its entirety.

FIELD OF THE INVENTION

The present invention relates generally to balloons. More particularly, the present invention relates to an adjustable weighted balloon handle that enables a balloon to hover within an indoor space. The weight of the handle may be adjusted such that the balloon's displacement from the ground may be modulated and/or adjusted as a person desires. The balloon handle may include an aperture for tying the handle to a ribbon at the end of a balloon.

BACKGROUND OF THE INVENTION

Rubber balloons trace their history back to scientist Michael Faraday who in 1824 created them to be used in his hydrogen experiments. A little over 100 years later, Neil Tillotson created the first modern latex balloon in 1931 when he made 15 balloons in the shape of his cat's head which he cut by hand using a pair of scissors. In that same decade, manufacturers were able to mass produce latex balloons, creating different colors and shapes, along with text appearing on the latex. This boom in production was aided by the development of a method of retarding the coagulation of liquid latex, allowing for rubber makers to transport raw latex in liquid form to manufacturing sites all over the world before the latex began degrading.

By the 1970s advances in technology had led to the advent of foil balloons. Foil balloons (also known commercially as Mylar balloons) are made of a thin, non-stretchable plastic film that is able to hold its shape without distorting. Foil balloons are often able to float longer than latex balloons when filled with helium gas and are also more able to be printed with complex graphics compared to latex balloons.

Today, party balloons are a common decoration found at gatherings and celebrations all over the world. Many wedding receptions, children's birthday parties, work-related parties, and festivals are often incomplete without balloons. Both foil and latex balloons are frequently filled with helium gas. This provides lift to the balloons such that they can float in air because of the density of helium is less than air.

Because of helium balloons lighter-than-air density, they often must be tethered to an object on the ground to prevent them from floating away. This may be done by tying a string to the tail of the balloon and then tying the balloon to an object that sits on the ground, such as a chair or a mailbox. Alternatively, the balloon may be tied to any object resting on a surface. However, the need to tether the balloon to a surface has posed a problem to customers who are unable to find a surface to tether the balloon, such as tourist who, for instance, purchase a balloon in an amusement park and may be outside for the whole day. Additionally, because balloons come in varying sizes and, as a result, varying volumes of helium filled in them, they exhibit different levels of lift. One-size-fits all weights that are used to tether a balloon in those instances may be inefficient in preventing all types of balloons from floating away.

A common solution to this problem has been to provide ballasts that are sufficient in weighing down the balloon. However, this has resulted in additional costs because balloon of varying sizes would need varying weights of ballasts, forcing store owners to carry many different types of ballasts. Additionally, many people would like to enjoy full use of helium filled balloon without having to tether them to a surface.

Accordingly, there remains a need in the art for a solution to at least one of the aforementioned problems. For instance, a mechanism is desired whereby a balloon may be able to levitate off the ground without being tethered to a surface. Additionally, it is desired that the mechanism be adjustable as helium escapes from the balloon. Preferably, it is also desired that the mechanism maintain the positive aesthetic quality of balloons.

SUMMARY OF THE INVENTION

The present invention is directed to an adjustable weighted balloon handle that allows for a balloon to levitate an intermediate distance off the ground. The adjustable weighted balloon handle includes a plurality of strips having a plurality of perforations creating tabs, wherein the tabs may be removed to adjust the weight of the handle. The handle may further include an aperture that may allow the handle to be tied to the balloon. A method for operating the adjustable weighted balloon handle is provided.

The adjustable weighted balloon handle may solve a number of problems currently associated with helium and other lighter-than-air balloons. Firstly, the adjustable weighted balloon handle may allow a user to levitate a balloon off the ground and not force the user to tether the balloon to a surface. Secondly, the balloon handle being adjustable by weight may allow a user to maintain the displacement of the balloon off the ground by removing weight as helium escapes from the balloon. Lastly, the balloon handle may be able to allow for correction if a user has removed more weight than desired by being able to add that weight back to the handle.

In a first implementation of the invention, an adjustable weighted balloon handle comprises:

- a plurality of strips with an indeterminate length having a proximal end and a distal end, the plurality of strips being bound together;
- a plurality of perforations along the indeterminate length of the plurality of strips, the plurality of perforations defining a plurality of tabs; and
- an aperture at at least one of the proximal end and the distal of the plurality of strips, the aperture configured to be tied to an end of a ribbon of a balloon; wherein at least one of the plurality of tabs is removable.

In a second aspect, the plurality of strips may be comprised of poster board.

In another aspect, the plurality of strips may be comprised of cardstock.

In another aspect, the plurality of strips may be bound together by a padding compound.

In another aspect, the plurality of strips may be bound together with staples.

In another aspect, the plurality of strips may range from 12 to 17 strips.

In another aspect, the plurality of strips may weight 0.5 oz.

In another aspect, the plurality of perforations may be ⅛ inch deep.

In another aspect, the plurality of perforations may be configured to remove the plurality of tabs.

In another aspect, the aperture may be ¼ inch.

In another aspect, the aperture may be ⅜ of an inch from at least one of the proximal end and the distal end of the plurality of strips.

In another aspect, the balloon may be comprised of latex.

In another aspect, the balloon may be comprised of Mylar.

In another aspect, the balloon may be filled with hydrogen.

In another aspect, the balloon may be filled with helium.

In another aspect, the balloon may be filled with any substance making the balloon lighter-than-air.

In another aspect, the removal of the at least one plurality of tabs may be configured to increase a displacement of the balloon off a ground.

In another aspect, the plurality of strips may be configured to hold removed tabs.

In another implementation of the invention, a method of operating the adjustable weighted balloon handle comprises:

obtaining an adjustable weighted balloon handle, the adjustable weight balloon handle being comprised of a plurality of strips that are bound together, a plurality of perforations along the plurality of strips wherein the plurality of perforations defines a plurality of tabs, and an aperture at at least one end of the plurality of strips;

tying the adjustable weighted balloon handle through the aperture to a ribbon at an end of a lighter-than-air balloon;

levitating the balloon at an indeterminate displacement above a ground, the indeterminate displacement being defined as D1, wherein as the balloon loses filing the balloon decreases its displacement off the ground, the decreased displacement being defined as D2; and removing at least one of the plurality of tabs such that the balloon increases its displacement off the ground, the increased displacement being as D3;

In another aspect, the increased displacement D3 may equal the original indeterminate displacement D1.

In another aspect, the removal of the at least one plurality of tabs may be from a single strip of the plurality of strips.

In another aspect, the removal of the at least one plurality of tabs may be from multiple strips of the plurality of strips.

In another aspect, the removed at least one plurality of tabs may be placed back into the adjustable weighted balloon handle such that the displacement of the balloon decreases.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an adjustable weighted balloon handle that is designed and configured to maintain an indeterminate displacement off the ground of a balloon to which the handle is attached. In particular, the adjustable weighted balloon handle may allow for a balloon to levitate off the ground and for the displacement off the ground to be adjusted by adjusting the weight of the handle. The adjustable weighted balloon handle may include a plurality of strips bound together and a plurality of perforations of the plurality of strips defining tabs. Additionally, the adjustable weighted balloon handle may include an aperture configured to allow a ribbon tied to a balloon to be tied to the handle.

Figure 1:
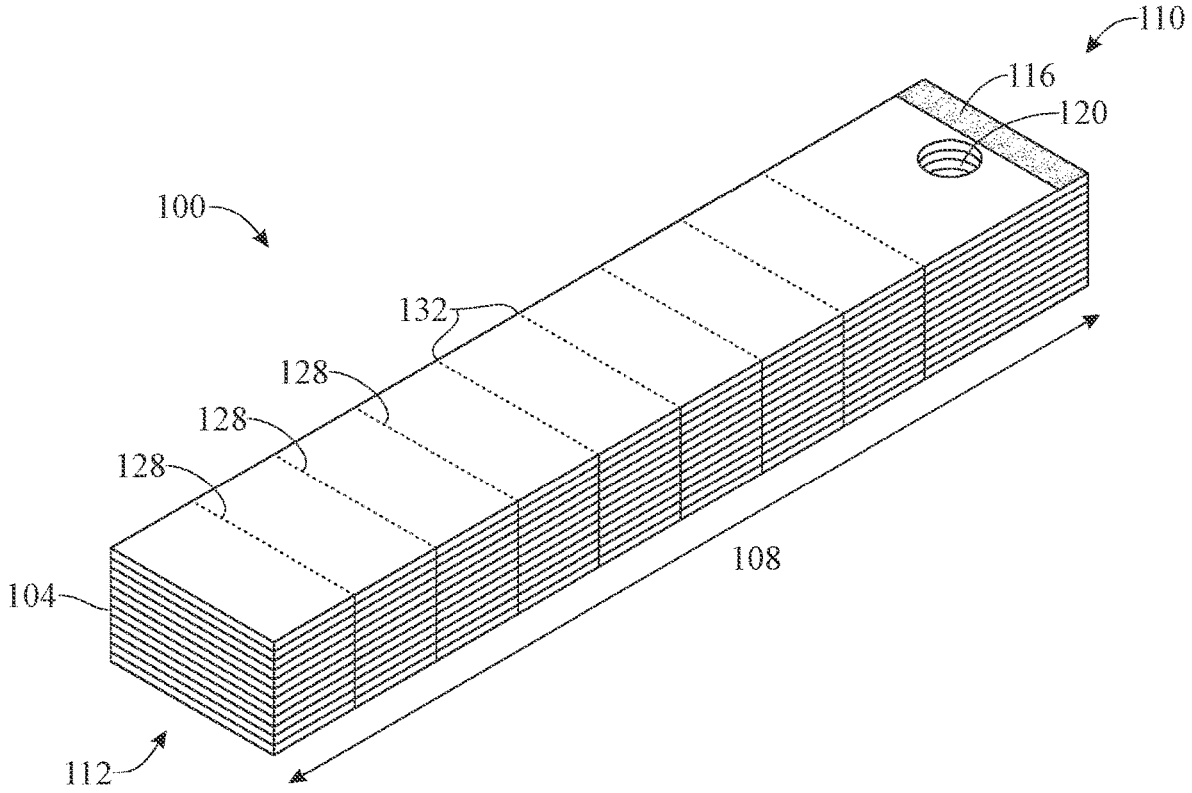
FIG. 1 presents a front isometric view of the adjustable weighted balloon handle in accordance with a first illustrative embodiment of the invention.
Figure 2:
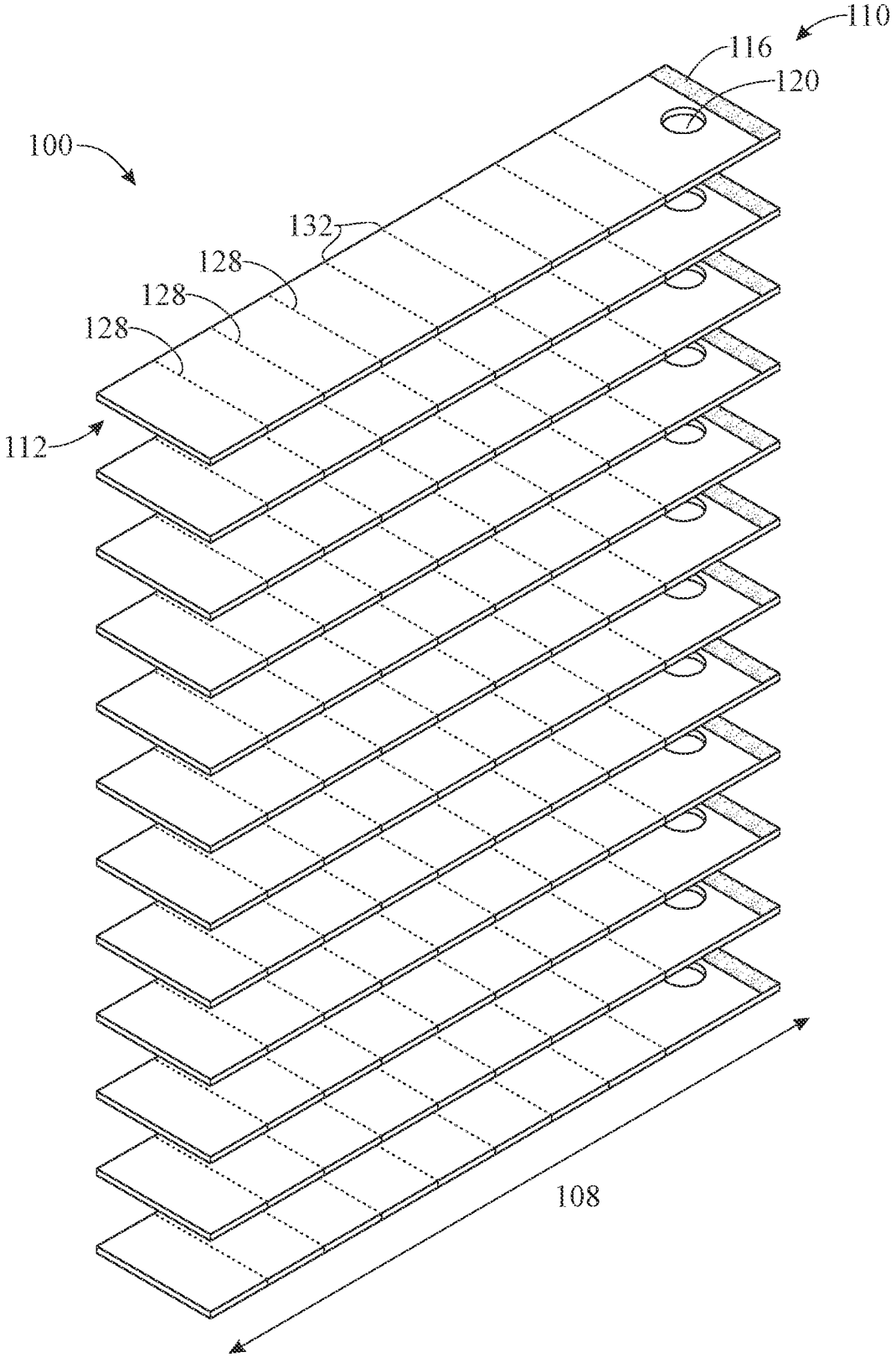
FIG. 2 presents an exploded, front isometric view of the adjustable weighted balloon handle illustrated in FIG. 1.

Referring initially to FIG. 1, an adjustable weighted balloon 100 is illustrated in accordance with an exemplary embodiment of the present invention. As best shown in FIG. 2, the adjustable weighted balloon handle 100 includes a plurality of strips 104. The plurality of strips 104 may be comprised of poster board. Alternatively, embodiments are envisioned wherein cardstock and/or another of paper-based products are used to create the plurality of strips 104. Other embodiment are envisioned wherein the plurality of strips 104 may be made from cloth or plastic. The number of strips in the plurality of strips 104 may vary depending on the size and weight of a balloon to which the handle 100 is attached. In the present embodiment, the plurality of strips 104 may range from 12 to 17 strips, however alternate embodiments are contemplated wherein more or less strips may be used. Additionally, each of the plurality of strips 104 is comprised of some weight. The weight may vary depending on a variety of variables such as the material and the length of the plurality of strips 104. In the present embodiment, the weight of the entire handle 100 may be approximately 0.5 oz. Referring back to FIG. 1, the plurality of strips 104 may be bound together to form an indeterminate length 108. The indeterminate length 108 of the plurality of strips 104 may include a proximal end 110 and a distal end 112.

Figure 3:
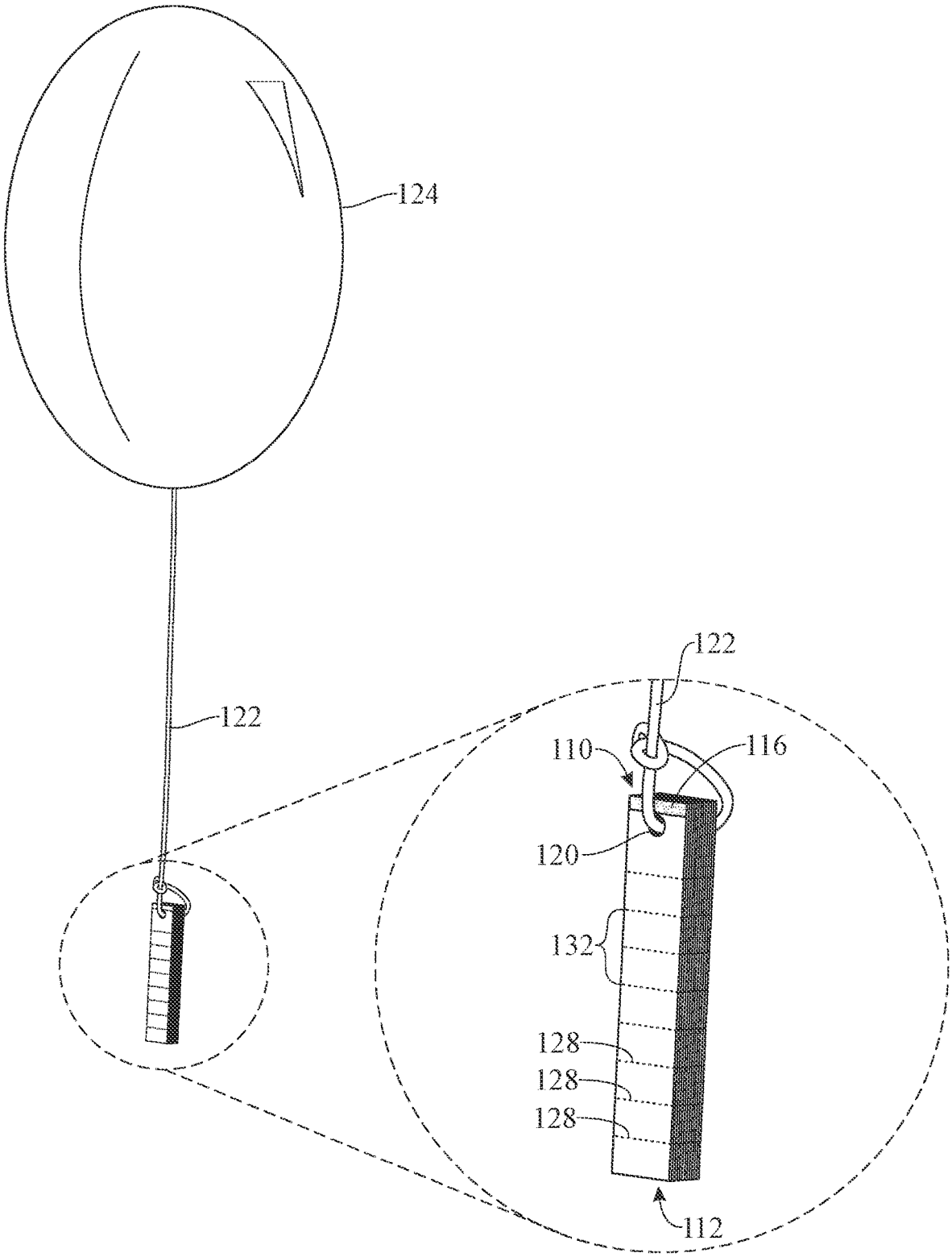
FIG. 3 presents a blown up view of the adjustable weighted balloon handle illustrated in FIG. 1, tied to a ribbon at the end of a balloon.

With continued reference to FIG. 1, at the proximal end 110 of the plurality of strips 104 may be a binding mechanism 116 to adhere each of the plurality of strips 104 to one another. The binding mechanism 116 may be for instance, a padding compound. A padding compound may allow each of the plurality of strips 104 to be torn off from the remaining plurality of strips 104. Alternatively, the binding mechanism 116 may be staples or any other agent that allows for the plurality of strips 104 to adhere to one another. Adjacent to the binding mechanism may be an aperture 120. The aperture 120 may be sized to allow the ribbon 122 of a balloon 124 to be tied through the aperture 120, as shown in FIG. 3. The aperture 120 in the present embodiment may be approximately ¼ inches. Referring back to FIG. 2, along the indeterminate length 108 of each of the plurality of strips 104, from the proximal end 110 to the distal end 112, may be a plurality of perforations 128. The plurality of perforations 128 may be equally spaced apart along the indeterminate length 108. Alternatively, the plurality of perforations 128 may have varying amounts of space in between each perforation 128. The depth of the plurality of perforations 128 may vary based on the thickness and/or the material of the plurality of strips 104. In the present embodiment, the depth of the plurality of perforations 128 may be approximately ⅛ inch.

The plurality of perforations 128 may define a plurality of tabs 132 along the indeterminate length 108 of the plurality of strips 104, wherein the plurality of tabs 132 may be the area between each of the plurality of perforations 128. Each of the plurality of tabs 132 may be removable from the remaining plurality of tabs 132. The number of the plurality of tabs 132 may vary depending on the length of each of the plurality of strips 104, as well as the number of perforations 128 along the indeterminate length 108. In the present embodiment, there may be 8 tabs 132 on each of the plurality of strips 104.

The illustrations of FIGS. 3-7 demonstrate an example method of operation the adjustable weighted balloon handle 100. Referring initially to FIG. 3, the adjustable weight balloon handle 100 may be tied to the end of the ribbon 122 of the balloon 124. More specifically, the adjustable weight balloon handle 100 may be tied to the ribbon 122 at the aperture 120 at the proximal end 110 of the plurality of strips 104. The balloon 124 may be comprise of latex or Mylar. Additionally, the balloon 124 may be filled with helium, hydrogen, or any other substance making the balloon 124 lighter than air.

Figure 4:
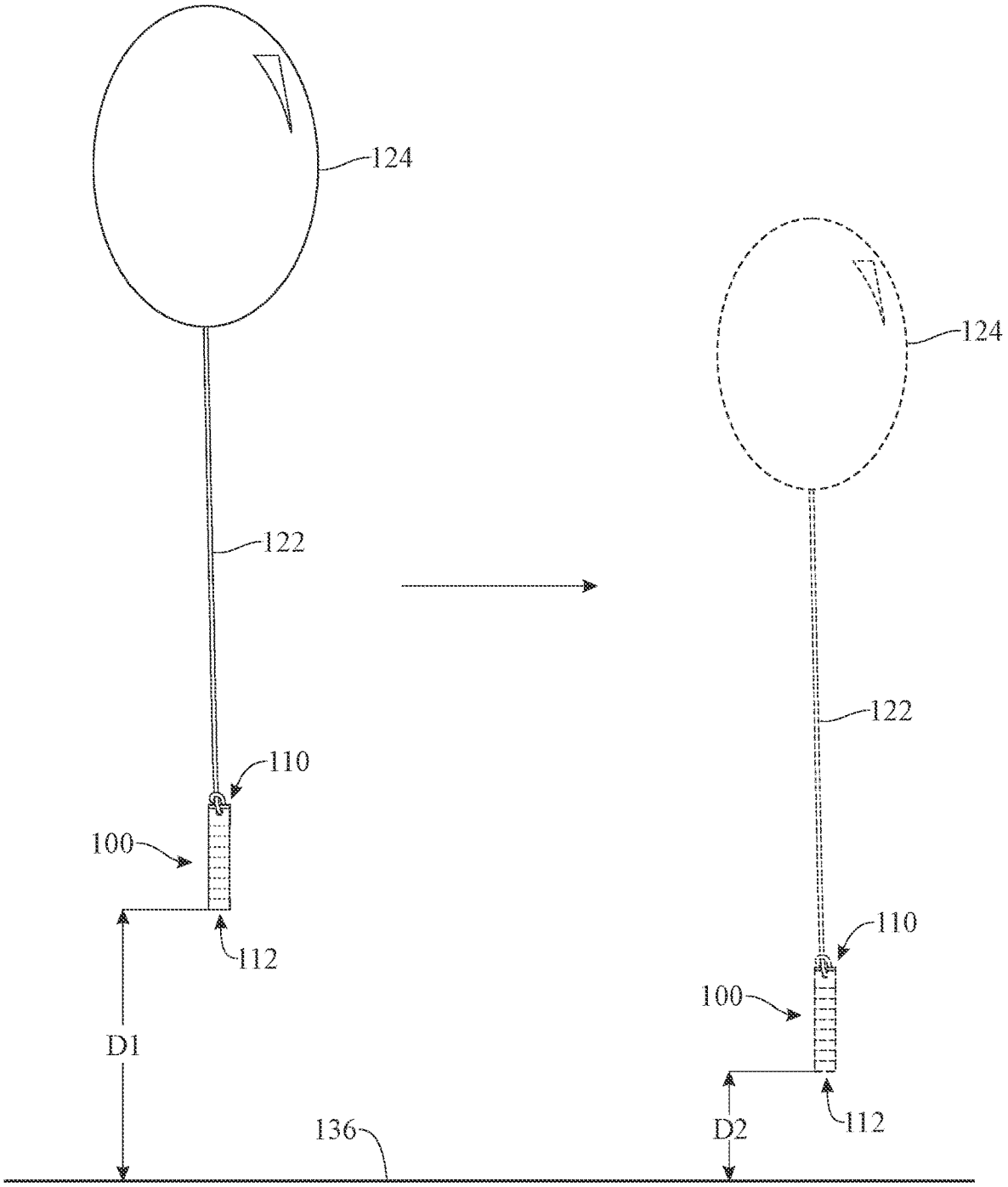
FIG. 4 presents a front view of the adjustable weighted balloon handle illustrated in FIG. 1, tied to a ribbon at the end of a balloon and showing a first original displacement, as well as a second displacement shown after some of the filling escapes the balloon.

Upon having the handle 100 tied to the ribbon 122, the balloon 124 may be allowed to levitate in the air, as shown in FIG. 4. The balloon 124 may be able to levitate from the weight of the handle 100, preventing the balloon 124 from lifting away. The distance by which the balloon 124 is able to levitate off a ground 136 may be defined as D1. Put another way, D1 may be defined as the distance between distal end 112 of the plurality of strips 104 of the handle 100 and the ground 136. Another term for this distance may be an indeterminate displacement. As helium, hydrogen, or the light-than-air substance escaped from the balloon 124, the balloon 124 begins to sink, decreasing the displacement between the handle 100 and the ground 136. This new displacement may be defined as D2, wherein D2 is less than D1.

Figure 5:
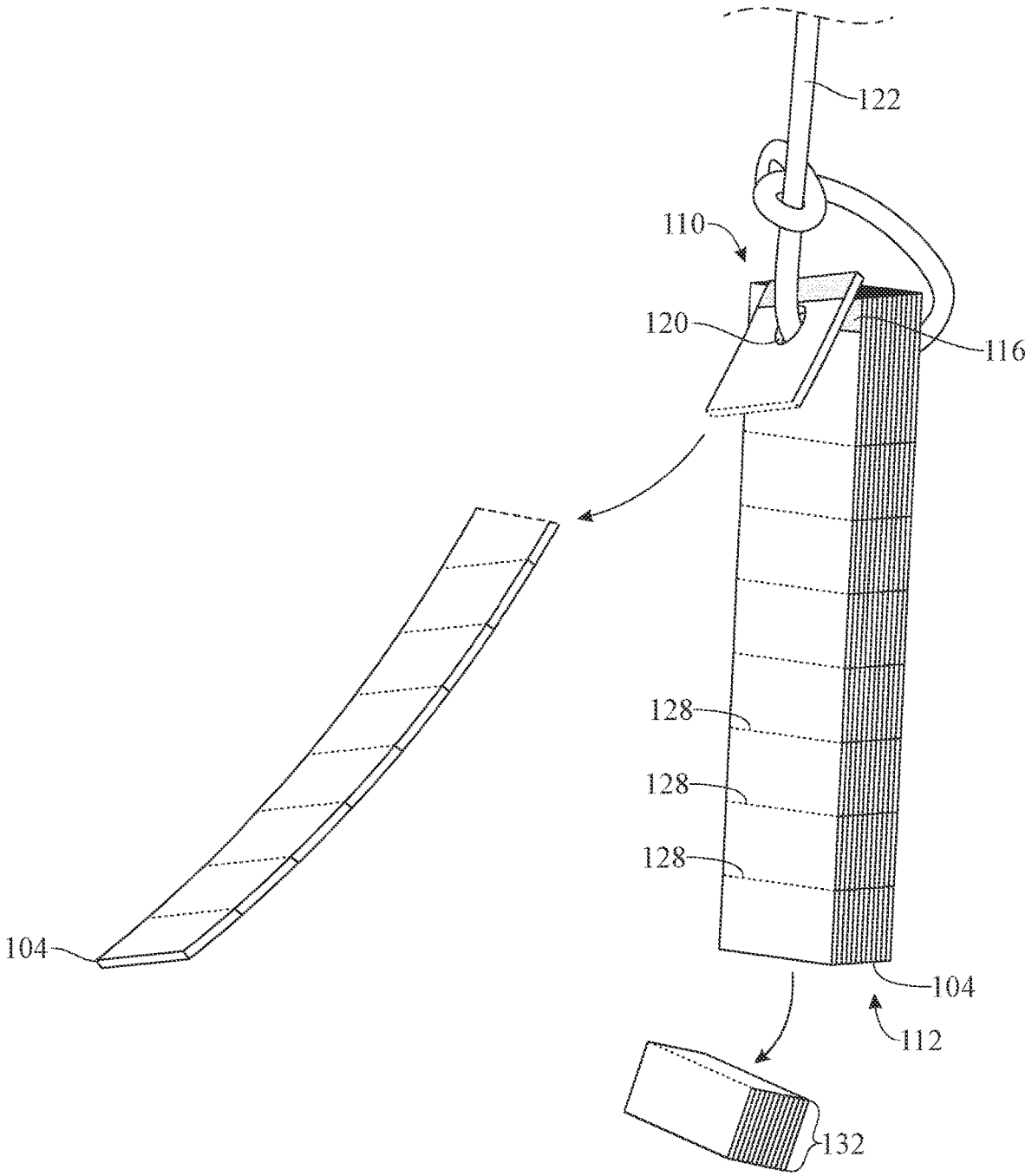
FIG. 5 presents a front view of the adjustable weighted balloon handle illustrated in FIG. 1, tied to a ribbon at the end of a balloon wherein at least one of a plurality of tabs are torn from the handle, and further wherein the at least one plurality of tabs are shown torn both from a single strip, as well as multiple strips.

In order to maintain original displacement off the ground, D1, a user may remove weight from the handle 100. Weight may be removed from the handle by removing at least one of the plurality of tabs 132, as shown in FIG. 5. More specifically, at least one of the plurality of tabs 132 may be removed by tearing on at least one of the plurality of perforations 128. A user may decide to tear/remove at least one of the plurality of tabs 132 from one strip of the plurality of strips 104. Alternatively, a user may be able to tear a plurality of tabs 132 along a single perforation 128 of the plurality of perforations 128. Tearing/removing tabs may require that tabs 132 closer to the distal end 112 of the indeterminate length 108 of the plurality of strips 104 be removed prior to a tab closer to the proximal end 110 of the same strip 104 may be removed.

Figure 6:
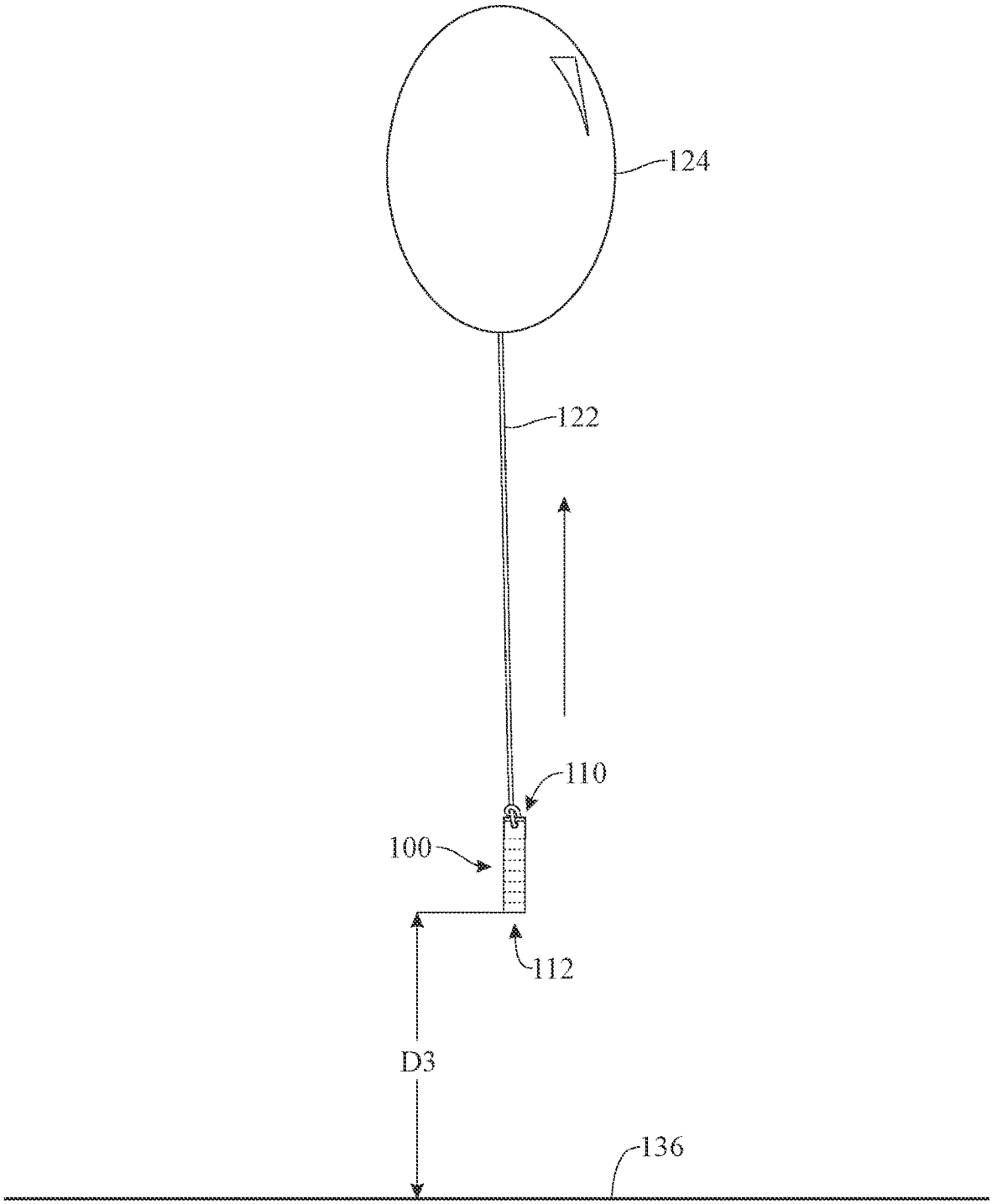
FIG. 6 presents a front view of the adjustable weighted balloon handle illustrated in FIG. 4 tied to a ribbon at the end of a balloon and showing a third displacement, the third displacement shown as at least one of the plurality of tabs are removed from the handle.
Figure 7:
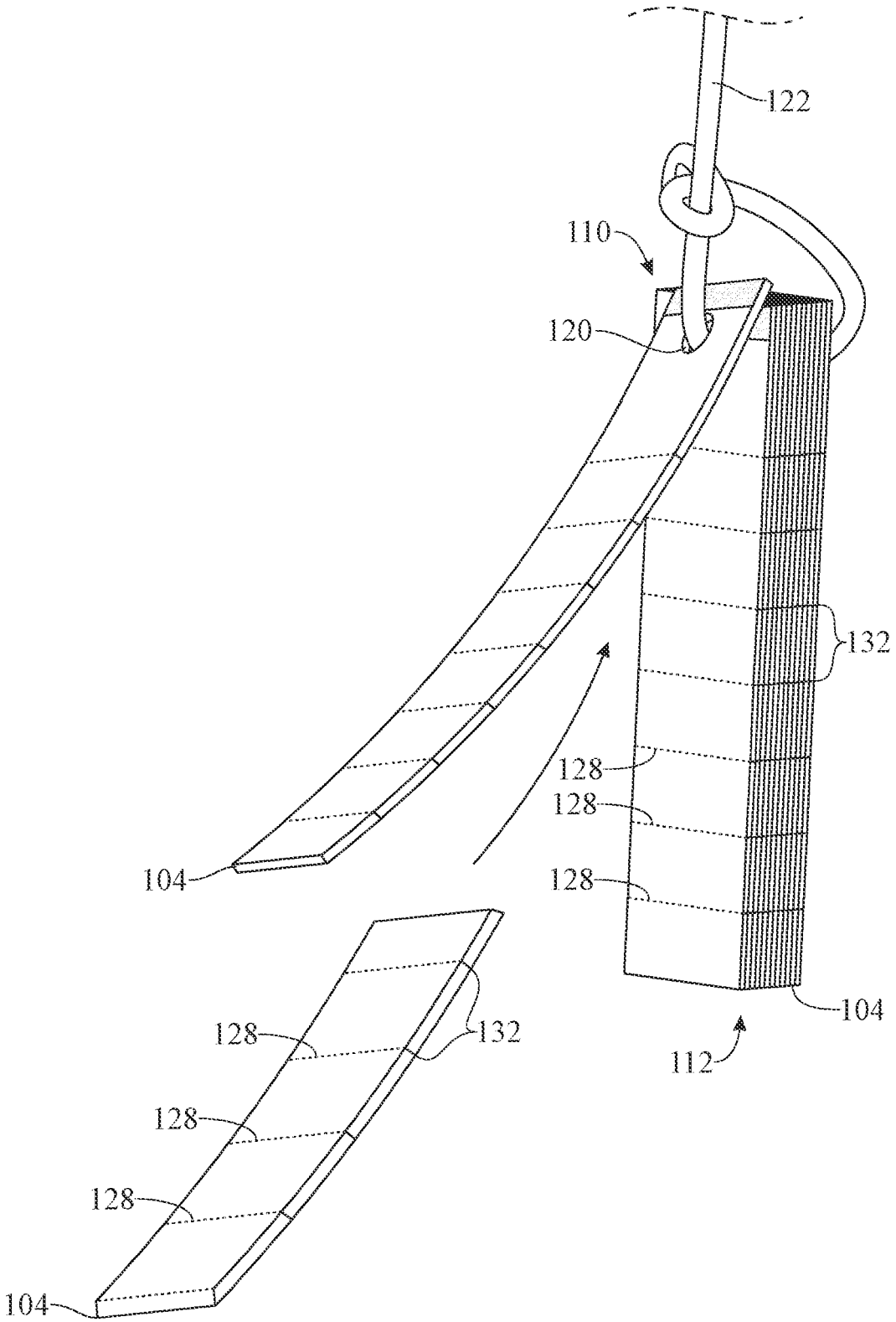
FIG. 7 presents a front view of the adjustable weighted balloon handle illustrated in FIG. 5, tied to a ribbon at the end of a balloon wherein at least one of a plurality of tabs are torn from the handle, and further wherein the at least one of the plurality of tabs may be placed back into the handle Like reference numerals refer to like parts throughout the several views of the drawings.

As tabs from the plurality of tabs 132 are removed, the weight of the handle 100 decreases. As the weight of the handle decreases 100, the balloon is able to provide greater lift. Thus, for a user to return to the original displacement off the ground a user may increase the displacement by removing tabs. As shown in FIG. 6, this new displacement may be defined as D3. D3 could equal D1. Or alternatively, if the user wants to provide the balloon 124 with even greater lift, D3 may be larger than D1 or any displacement that is greater than D2. If a user has removed too many tabs such that the displacement is larger than the user desires, then the user may place at least one of the plurality of tabs 132 back into the handle 100, as shown as FIG. 7. The weight from the remaining plurality of strips 104 may be able to hold the torn off tabs in place. Similarly, an individual tab 132 that has been removed may also be added back by placing the individual tab 132 back in between two of the plurality of tabs 132. As more weight is added to the handle, in the form of torn off tabs, the displacement of the balloon 124 off the ground may decrease.

Alternative embodiments are contemplated to those shown or described herein without departing from the scope of the present disclosure. For example, embodiments are contemplated in which the length, width, and weight of the handle may vary. This is because balloons may come in all different kinds of shapes, sizes, and weights, and thus, a handle may need to accommodate for different types of balloons. Another alternative embodiment considered is the ability of the handle to allow printing of texts and/or graphics on the plurality of strips. This may allow for advertising and may improve the aesthetic quality of the handle. Along those lines, embodiments are also envisioned wherein the strips may each have varying sizes compared to the remaining plurality of strips and furthermore, it is also envisioned that the perforations may not necessarily be straight. This would allow users to tear of tabs in different shapes and may allow for the handle to take on a different aesthetic. As such, the handle may become an accessory that enhances the illusion of the balloon.

In summary, the adjustable weighted balloon handle disclosed herein provides a mechanism that that allows a user to allow a lighter-than-air balloon to levitate in the air without flying away. The adjustable weighted balloon handle may further allow for the weight to be adjusted such that a user may adjust the displacement of the balloon off the ground as the balloon loses its filling. The adjustable weighted balloon handle may also be configured to allow weight, in the form of tabs, that have been removed to placed back into the handle to increase the weight if too much has been removed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An adjustable weighted balloon handle configured for detachable attachment to a balloon, said adjustable weighted balloon handle comprising:

a plurality of strips having a length from a proximal end to a distal end, the plurality of strips being bound together;

a plurality of perforations along the length of the plurality of strips, the plurality of perforations defining a plurality of tabs; and an aperture at at least one of the proximal end and the distal of the plurality of strips, the aperture configured to be tied to an end of a ribbon of said balloon;

wherein at least one of the plurality of tabs is removable;

wherein the plurality of strips are bound together through a binding mechanism at one of the proximal end and the distal end;

wherein the plurality of perforations are configured to enable one or more tabs of the plurality of tabs to be removed from the plurality of strips;

wherein the handle is configured to enable one or more of the plurality of strips to be removed from the plurality of strips simultaneously;

wherein the handle is configured to enable multiple tabs of the plurality of tabs to be removed on multiple strips of the plurality of strips simultaneously;

wherein the removal of the at least one plurality of tabs is configured to increase a displacement of said balloon off a ground;

wherein at least one of the plurality of tabs is configured to reattached to the plurality of strips by insertion between the plurality of strips; and wherein the reattachment of the at least one plurality of tabs is configured to decrease a displacement of the balloon off a ground.

2. The balloon handle of claim 1, wherein the plurality of strips are comprised of poster board.

3. The balloon handle of claim 1, wherein the plurality of strips are comprised of cardstock.

4. The balloon handle of claim 1, wherein the plurality of strips are bound together through a binding mechanism at the proximal end.

5. The balloon handle of claim 4, wherein the binding mechanism is a padding compound.

6. The balloon handle of claim 4, wherein the binding mechanism is staples.

7. The balloon handle of claim 1, wherein the plurality of strips range from 12 to 17 strips.

8. The balloon handle of claim 1, wherein the plurality of strips weigh 0.5 oz.

9. The balloon handle of claim 1, wherein the plurality of perforations are evenly spaced apart along the length of the plurality of strips such that each of the plurality of tabs are the same length.

10. The balloon handle of claim 1, wherein the plurality of perforations are spaced apart from each other along the length of the plurality of strips such that each of the plurality of the plurality of tabs are varying lengths.

11. The balloon handle of claim 1, wherein the aperture is ¼ inch.

12. The balloon handle of claim 1, wherein the balloon is comprised of latex.

13. The balloon handle of claim 1, wherein the balloon is filled with a substance making the balloon lighter-than-air.

* * * * *